US006018119A

United States Patent [19]

Mladek

[11] Patent Number: 6,018,119

[45] Date of Patent: Jan. 25, 2000

[54] STRINGLESS TWITCH FRET INSTRUMENT

[76] Inventor: Ivan Mladek, Krajnikova 141, 252 29 Dobrichovice, Czech Rep.

[21] Appl. No.: 08/973,073

[22] PCT Filed: Feb. 11, 1997

[86] PCT No.: PCT/CZ97/00005

§ 371 Date: Feb. 23, 1998

§ 102(e) Date: Feb. 23, 1998

[87] PCT Pub. No.: WO97/33272

PCT Pub. Date: Sep. 12, 1997

[30] Foreign Application Priority Data

Mar. 5, 1996 [CZ] Czech Rep. ..... 663-96

[51] Int. Cl.[7] ..... G10H 1/18

[52] U.S. Cl. ..... 84/722; 84/743

[58] Field of Search ..... 84/722, 743

[56] References Cited

U.S. PATENT DOCUMENTS

| | | | |
|---|---|---|---|
| 3,555,166 | 1/1971 | Gasser | 84/1.01 |
| 4,336,734 | 6/1982 | Polson | 84/646 |
| 4,339,979 | 7/1982 | Norman . | |
| 5,085,119 | 2/1992 | Cole | 84/724 |
| 5,095,799 | 3/1992 | Wallace et al. | 84/609 |
| 5,121,668 | 6/1992 | Segan et al. | 84/646 |
| 5,398,585 | 3/1995 | Starr | 84/646 |

FOREIGN PATENT DOCUMENTS

| | | |
|---|---|---|
| 2557721 | 7/1985 | France . |
| 3519047 | 12/1986 | Germany . |

*Primary Examiner*—Jeffrey Donels
*Attorney, Agent, or Firm*—Ladas & Parry

[57] ABSTRACT

The stringless fret instrument to be played as on a twitch instrument consists of the neck (1) on which there are frets (2) located transversely to a lengthwise axis of the neck (1), between which there are situated, in rows parallel with the axis of the neck (1), digital tone push-buttons (3), and of the body (5) equipped with the management (6) of the synthesizer accompaniment, a loudspeaker (4) and a direct current charger. Above each row of digital tone push-buttons (3), there is a flexible rope (31) situated in a lengthwise rabbet (32) created in the neck (1) parallel with the lengthwise axis of the neck (1), movable in the direction to digital tone push-buttons (3), fixed at least on the neck (1) behind the side digital tone push-button (3). The management (6) of the synthesizer accompaniment consists of three mutually parallel rows of keys (7 to 18) each of which consisting of four tone keys (7 to 18).

15 Claims, 3 Drawing Sheets

STRINGLESS TWITCH FRET INSTRUMENT

BACKGROUND OF THE INVENTION

1. Field of the Invention

The invention relates to a stringless fret instrument to be played on a twitch instrument, e.g. a stringless guitar, banjo etc., which consists of a neck on which there are frets situated transverse to the lengthwise axis of the neck having between them digital tone push-buttons in rows parallel with the neck axis, and a body, a loudspeaker and a direct current charger.

2. Description of the Related Art

Stringless instruments for at least partial music production as on twitch instruments are well known. The use of a number of them however requires a special technique of playing which entirely differs from the technique of playing on common string instruments. The electrical stringless guitar described in U.S. Pat. No. 5,095,799 is constructed with a view of a minimal standard of ability to create a musical tone. The neck has eight band push-buttons for pre-programming musical bands, and on the body there are eight melody push-buttons, two time push-buttons and a speed control push-button, chord push-button, a height push-button, and a volume (loudness) push-button, etc.

The electronic guitar according to U.S. Pat. No. 5,121,668, which also enables easy play, is allied to the common guitar and serves as an instrument for teaching how to play on this guitar. It generates a musical signal for the player's play and consists of a neck and a body on which there are several manually used strings. The musical signal includes a component corresponding to the sound of one or more strings and of one or more manually used pieces of equipment located along the neck.

Some types of stringless fret instruments, e.g. a guitar described in U.S. Pat. No. 3,555,166 and U.S. Pat. No. 5,398,585 and a solution according to FR 2 557 721 and DE 35 19 047, permit, at least partly, abilities necessary to play a common string instrument.

The electronic musical instrument with a double manual described in U.S. Pat. No. 3,555,166 is equipped with managing push-buttons in vents created on the neck, while a length of each push-button corresponds to the length of a part of string between individual frets on a common string instrument. Each push-button is a part of a switch contact which is activated when a push-button is pressed. In regard to the type described as a guitar, there are 20 push-buttons in each of the six rows of push-buttons. There is a coupled manual situated on the musical instrument body with push-buttons situated on the neck. This coupled manual manages switches from two or more rows on the neck. Each of the tone generators situated on the musical instrument body is coupled to the tone formation when pertinent push-buttons on the neck and on the coupled manual are connected. This allows one to play various chords resembling the fingering on several strings. Before some of the push-buttons on the neck can played a chosen chord and the pertinent push-button of a coupled manual must be pressed.

In regard to the solution described in U.S. Pat. No. 5,398,585 the guitar neck is equipped with six rows of twenty individual push-buttons placed in a way which corresponds to the tuning fret/string on a common guitar. On the body of the guitar there are sixteen push-buttons for a number of functions, e.g. for tuning as on a common guitar, a bass guitar, a violin, for lowering the fifth interspace, for increasing the fifth interspace, etc. In the mid of the guitar body, there are six blocks for synthesizing a sound of the drum, as a pitch bend, for modulation, for stereo-audition, etc., and further on the body, there are six lengthwise switch contacts used for laying up individual push-buttons on the neck and for a synthesized sound of the drum.

DE 35 19 047 concerns a double-manual electronic guitar with an electronic neck which allows not only characteristic guitar chords but also, with the aid of specialized keys which are situated under the strings, that when a string is pressed, these keys are mastered in the same time, while a contact is switched inside the neck.

SUMMARY OF THE INVENTION

The invention includes a stringless fret instrument for playing, as on a twitch instrument of the above mentioned type which easily allows one to generate music even with a minimally mastered technique of playing on a string fret instrument, as is achieved on a normal string instrument, e.g. a guitar. At the same time the instrument, from the view of its mastering, must come up as much as possible to a common string instrument so that, for instance, visual control is not necessary to attend accompanying pieces of equipment which are situated on the instrument neck.

This task is solved by a stringless fret instrument for playing as a twitch instrument, comprising a neck with digital tone push-buttons situated between transverse frets in a lengthwise rabbet or groove parallel with the neck where a flexible rope or string is inserted and fixed behind side digital tone push-buttons. Each digital tone push-button is managed by one hand fingering for playing a guitar to generate a sound from the loudspeaker as playing a guitar, and a body with an accompaniment management keys or buttons to provide an accompaniment for playing a guitar.

For optimal management of the instrument, like a common guitar, it is desirable that a flexible rope in a non-tied state reposes against rests created in the rabbet or groove in an area under frets.

Optimal management of accompanying equipment and minimal sight control is made possible by a stringless fret instrument for playing as a twitch instrument comprising a neck manageable by one hand fingering for playing a guitar,. generating sound from a loudspeaker as in playing a guitar, and a body with an accompaniment management which comprises three mutually parallel rows of keys, each row consisting of four tone keys. Switching individual keys in the upper row in the direction going from the edge of the body produces an A-chord, D-chord, G-chord and C-chord. Switching individual keys in the middle row in the direction going from the edge of the body produces an E-chord, Es-chord, Ais-chord and F-chord. Switching individual keys in the lower row produces an H-chord, Fis-chord, Des-chord and As-chord.

Another embodiment of the invention is a stringless fret instrument for playing a twitch instrument comprising a neck manageable by one hand fingering for playing a guitar, generating sound from a loudspeaker, as in playing a guitar, and a body with an accompaniment management which comprises four mutually parallel rows of keys, each row consisting of four tone keys. Switching individual keys in the upper row in the direction going from the edge of the body produces a D-chord, G-chord, C-chord and F-chord. Switching individual keys in the middle row in the direction going from the edge of the body produces an A-chord, Fis-chord, Des-chord and Ais-chord. Switching individual keys in the lower row produces an E-chord, H-chord, As-chord and Es-chord.

In playing an instrument it is advantageous for a player of a stringless fret instrument to press a digital tone push-button which blocks digital tone push-buttons in a row with this digital tone push-button, parallel with a lengthwise axis of the neck between this digital tone push-button and a free end of the neck. This simulates a twitching on a string instrument when a string produces a tone in dependence on its last pressing to the fret in the direction going to the body, and it does not react to a simultaneous pressing of the same string since the mentioned pressing in the direction going to a free end of the neck.

On a stringless fret instrument, there can also be push-buttons in the area of the accompaniment management and a switching of the push-buttons produces a change of the major key accompaniment to the minor key accompaniment, a change of the major key accompaniment to a fitting chord, a change of the major accompaniment to a magnified chord and a dominant septet chord and the stop, further on the body management of a strength of a sound accompaniment, push-buttons which when pressed change a rhythm of playing a management changing the play time, and a management changing the bass altitudes.

BRIEF DESCRIPTION OF THE DRAWINGS

Preferred features of the present invention can be best understood by reference to the description in conjunction with the following drawing figures in which.

DESCRIPTION OF THE ILLUSTRATED EMBODIMENTS

Figure 1:
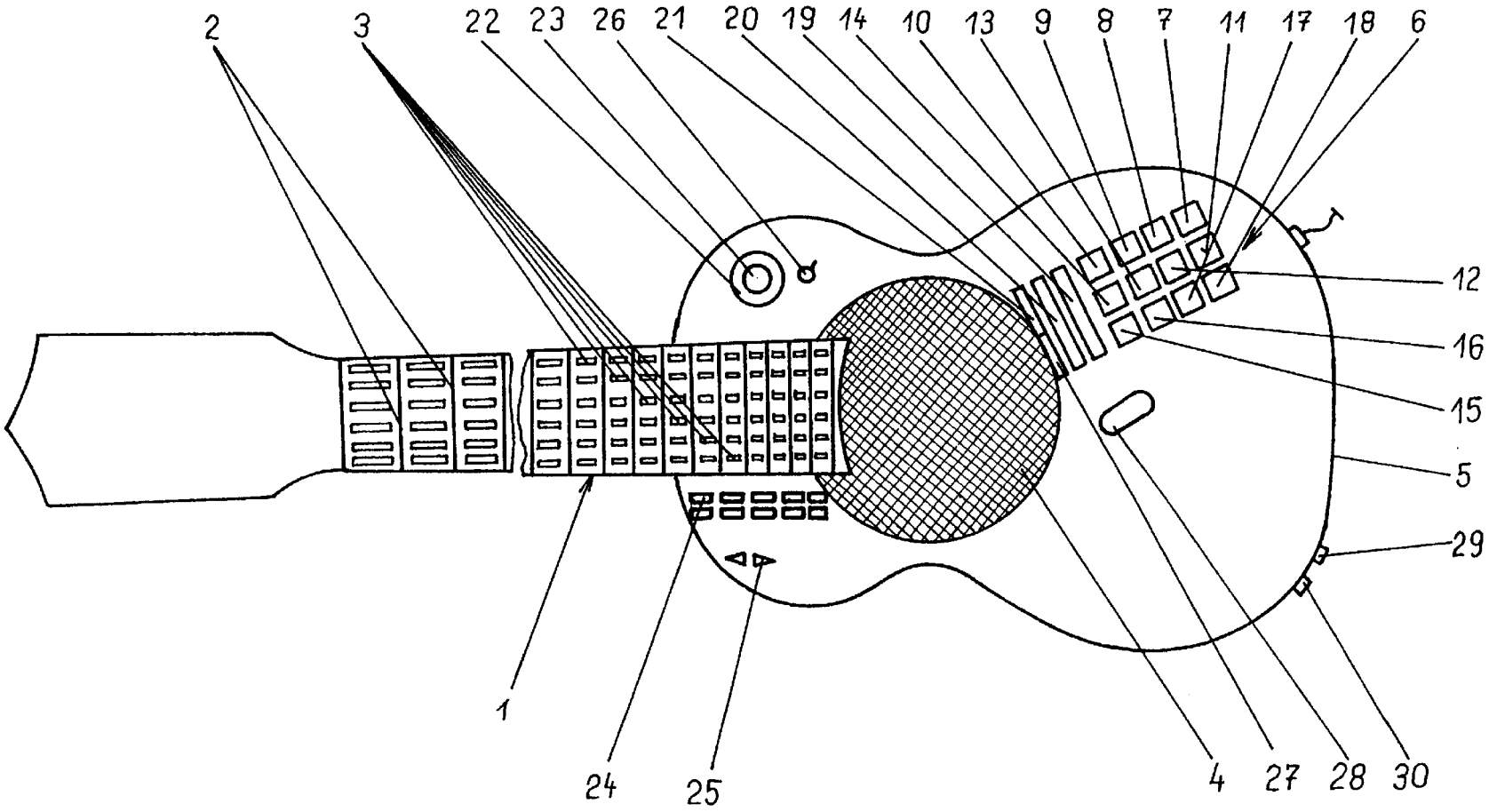
FIG. 1 a view of the stringless guitar according to the invention

The guitar in the figures consists of a body 5 which has a shape typical for a common guitar. It can have, however, a different suitable shape, since the shape or the size are not restricted by the shape and size of the resonance cavity. On the spot where there is a passage into cavities, as in the case of a classical guitar, there is situated on the body 5 a loudspeaker 4. Going from the loudspeaker 4 in a direction of a lengthwise axis of the body 5, fixed to the body 5 is a neck 1. Alternatively, the loudspeaker can be distinct from the neck 1 and body 5 combination and electrically coupled to the body or neck.

The neck 1 also has a shape analogous to a classical guitar. The termination of the guitar neck 1 into a shape similar to the tuning part of a classical guitar is not, however, indispensable. Frets 2 are situated on the neck and transverse to a lengthwise axis of the neck 1 in fixed distances between individual frets. Between two neighboring frets 2, one fret behind the other and parallel with the lengthwise axis of the neck 1, are six digital tone push-buttons 3. Above each row of digital tone push-buttons 3, in a lengthwise rabbet or groove 32 created in the neck 1 and movable in the direction to digital tone push-buttons 3, there is a flexible rope or string 31 constituted by a steel bearing nucleus in the shape of a wire covered on the total girth by a plastic material and fixed at least on the neck 1 behind a side digital tone push-button 3. This flexible rope 31 leans against rests 33 created in the lengthwise rabbet 32 in an area under frets 2. Each digital tone push-button 3 is connected to a tone generating source or device, not shown in the figures, which is connected to the loudspeaker 4 which is a an integral part of this tone source. Alternatively, the loudspeaker and tone source can be separate from the neck and body combination, but electrically connected to the buttons and keys on the instrument. The digital tone push-button 3 is connected to the tones source which is higher by a half-tone with respect to the tone source connected to the preceding digital tone push-button 3, in a direction going from the free end of the neck 1, in the row of digital tone push-buttons 3, fixed parallel with the axis of the neck 1. Digital tone push buttons 3, the tone source and the loudspeaker 4 are connected at the same time to a direct current charger, not shown in the figures for sake of clarity. This direct current charger can be a part of the guitar, and it can be equipped by an accumulator source or connected to a power network. The digital tone push-button 3 functions, e.g. in a pressed position, by blocking the branch starting by a digital tone push-button 3 parallel with the lengthwise axis of the neck 1 between this digital tone push-button 3 and the free end of the neck 1, and terminating by the loudspeaker 4.

On the body 5 there is situated a synthesizer management 6 of the synthesizer accompaniment, and in that area there is at least one of the following push-buttons: a push-button 19 of a major key accompaniment change into a minor (moll) accompaniment, a push-button 20 of the major key accompaniment change into a fitting chord, a push-button 21 of the major key accompaniment change into a magnified chord and a push-button 27 of a perfect (dominant) septet-chord. On the body 5 there is also a management 22 of a sound strength of the tone source which is connected to a source of the synthesizer tone. On the body 5 there are ten push-buttons 24 of a rhythm selector which are connected to the tone source and/or to the source of the synthesizer tone and/or to the loudspeaker 4, a management 25 of a time (beat) selector which is connected to the tone source and/or to the source of the synthesizer tone and/or to the loudspeaker, and a management 26 of bass altitudes which is connected to the tone source and/or to the source of the synthesizer tone and/or to the loudspeaker. On the body 5 there can also be a switching push-button which is not shown in the figures.

Management 6 of the synthesizer accompaniment is connected to the source of the synthesizer tone, which is connected to the loudspeaker 4. This management 6 of the synthesizer accompaniment consists of three mutually parallel rows of keys 7 to 18. In the upper row in the direction going from the edge of the body 5 successively, a key 7 of the A-chord, a key 8 of the D-chord, a key 9 of the G-chord and a key 10 of the C-chord. In the middle row in the direction going from the edge of the body 5 successively, a key 11 of the E-chord, a key 12 of the Es-chord, a key 13 of the Ais-chord and a key 14 of the F-chord. In the lower row in the direction going from the edge of the body 5 successively, a key 18 of the H-chord, a key 17 of the Fis-chord, a key 16 of the Des-chord and a key 15 of the As-chord.

The indicated execution of the management 6 of the synthesizer accompaniment enables an average amateur player to easily manipulate the synthesizer accompaniment with a full concentration on playing on the neck with the left hand.

Figure 2:
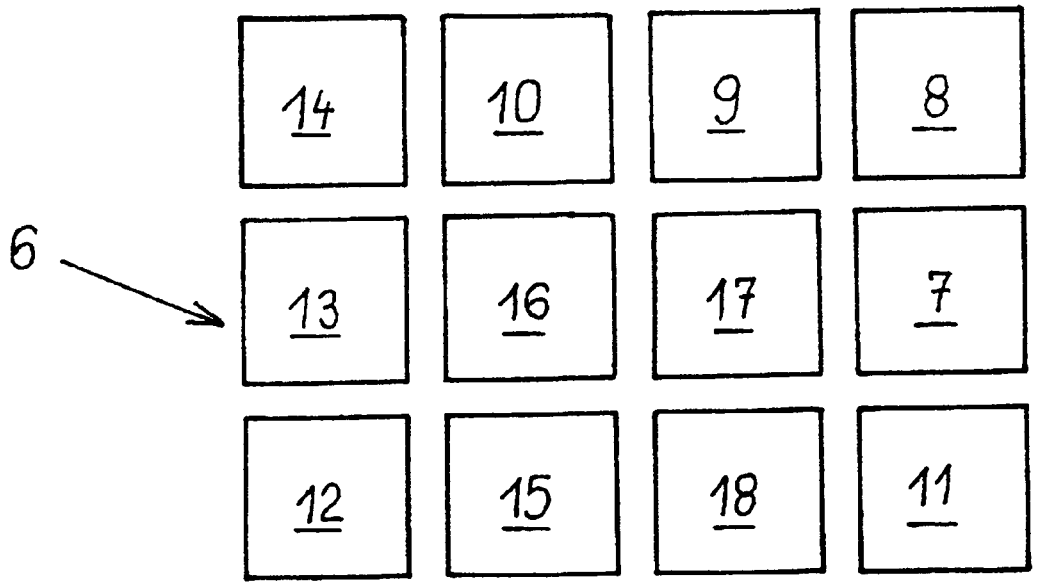
FIG. 2 a view of a further execution of the management of synthesizer accompaniment, and FIG. 3 a lengthwise cut by a lengthwise rabbet in the neck in which a flexible rope is situated.
Figure 3:
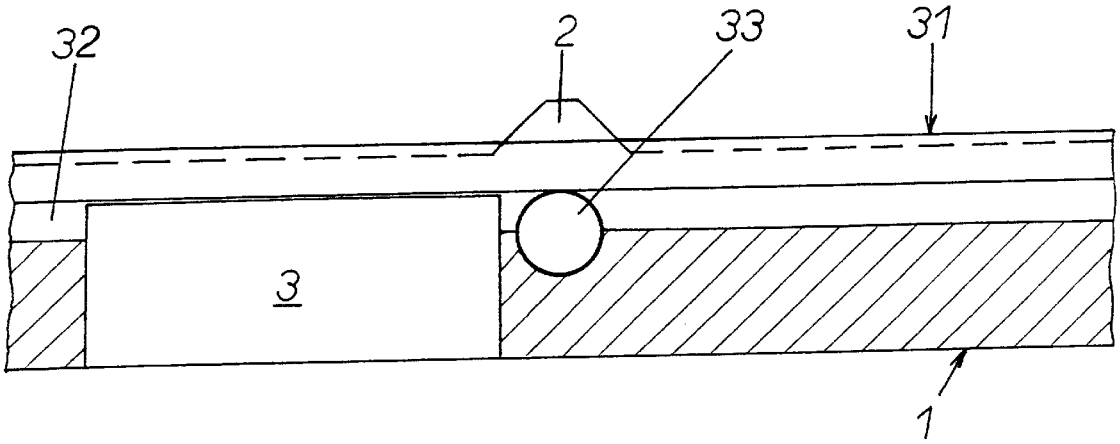

The management 6 of the synthesizer accompaniment according to the FIG. 2 is easily accomplished. Management 6 of the synthesizer accompaniment consists of three mutually parallel rows of keys 7 to 18. Situated in the upper row in the direction going from the edge of the body 5 successively, a key 8 of the D-chord, a key 9 of the G-chord, a key 10 of the C-chord and a key 14 of the F-chord. In the middle row in the direction going from the edge of the body 5 successively, a key 7 of the A-chord, a key 17 of the Fis-chord, a key 16 of the Des-chord and a key 13 of the Ais-chord. In the lower row in the direction going from the edge of the body 5 successively, a key 11 of the E-chord, a key 18 of the H-chord, a key 15 of the As-chord and a key 12 of the Es-chord.

By pressing pertinent keys 7 to 18 a player will bring into action the accompaniment play, i.e. bass, harmonic seconding, eventually beat seconding in major key chord pursuant to the selected key 7 to 18. The player masters the management 6 of the synthesizer accompaniment by four fingers, the forefinger, middle finger, ring-finger and little finger.

The push-button 19 of the major key accompaniment change into the minor (moll) accompaniment, the push-button 20 of the major key accompaniment change into the fitting chord, the push-button 21 of the major key accompaniment change into the magnified chord and the push-button 27 of the perfect (dominant) septet-chord are also connected to the source of the synthesizer tone. The player manages these push-buttons 19 to 21 and 27 by his thumb.

On the body 5 above the management 6 of the synthesizer accompaniment there is situated a stop push-button 28 which a player masters by his palm. By using the stop push-button the synthesizer accompaniment play is terminated.

The body 5 is further equipped by an entrance 29 for the apparatus and by an entrance 30 for a foot vibrator. Both these entrances 29 and 30 are connected to the loudspeaker 4.

The guitar according to the invention enables a player to play a substantially broader scope of musical sounds than guitars of the existing prior art.

I claim:

1. A stringless fret instrument for playing as a twitch instrument, comprising a neck with digital tone push-buttons situated between transverse frets in a lengthwise groove parallel with the neck and a flexible string in the groove on top of the digital tone push-buttons for each of the digital tone push-buttons to be manipulated by one-hand fingering as in playing a guitar, means for generating sound by a speaker in response to the manipulated digital tone push-buttons, and a body part attached to the neck.

2. The stringless fret instrument as claimed in claim 1, wherein the flexible string is positioned against rests in the groove in an area under the frets.

3. The stringless fret instrument as claimed in claim 1, wherein a manipulated one of the digital tone push-buttons blocks the generating of the sound in response to another manipulated one of the digital tone push-buttons in a direction toward a free end of the neck.

4. A stringless fret instrument to be played as a twitch instrument, comprising a neck, and a body fixed to said neck and having a speaker therein, said body having thereon rows of keys, each of the rows including four of the keys which, when switched on, prompt generation by a tone generating source of a respective tone signal representing a chord, the tone signal being received and reproduced by a speaker, said tone generating source and said speaker each being one of on said body and separate from said body, individual of the keys in an upper row in a direction going from an edge of the body corresponding to A-chord, D-chord, G-chord and C-chord keys respectively, individual of the keys in a middle row in the direction going from the edge of the body corresponding to E-chord, Es-chord, Ais-chord and F-chord keys, respectively, and individual of the keys in a lower row corresponding to H-chord, Fis-chord, Des-chord and As-chord keys, respectively.

5. The stringless fret instrument as claimed in claim 4, further comprising push-buttons which, when activated, respectively change each of the chords switched on from a major key to a minor key, to an augmented chord and to a dominant seventh chord.

6. The stringless fret instrument as claimed in claim 4, wherein the body has a key for management of a strength of the reproduced tone signal.

7. The stringless fret instrument as claimed in claim 4, further comprising push-buttons on the body which, when activated, change a rhythm of the tone signal.

8. The stringless fret instrument as claimed in claim 4, wherein the body comprises means for keyed management which changes a time beat of the tone signal.

9. The stringless fret instrument a claimed in claim 4, wherein the body comprises means for keyed management which, when activated, changes bass altitudes of the tone signal.

10. A stringless fret instrument to be played as a twitch instrument, comprising a neck for manipulating by one hand fingering as playing a guitar and generating a sound from a loudspeaker; and a body with means for keyed accompaniment management comprising upper, middle and lower parallel rows of chord keys, each of the rows consisting of four of the chord keys for respectively producing in a direction from an edge of the body when switched on a D-chord, G-chord, C-chord and F-chord an A-chord, Fis-chord Des-chord and Ais-chord, and an E-chord, H-chord, As-chord and Es-chord.

11. The stringless fret instrument as claimed in claim 10, further comprising push-buttons which, when activated, respectively chance each of the chords switched on from a major key to a minor key, to an augmented chord and to a dominant seventh chord.

12. The stringless fret instrument as claimed in claim 10, wherein the body comprises means for keyed management of a strength of the produced chord.

13. The stringless fret instrument as claimed in claim 10, further comprising push-buttons on the body which, when activated, change a rhythm of the produced chord.

14. The stringless fret instrument as claimed in claim 10, wherein the body comprises means for keyed management which changes a time beat of the produced chord.

15. The stringless fret instrument as claimed in claim 10, wherein the body comprises means for keyed management which, when activated, changes bass altitudes of the produced chord.

* * * * *